US008858675B2

(12) United States Patent
Larsson

(10) Patent No.: US 8,858,675 B2
(45) Date of Patent: Oct. 14, 2014

(54) IRON-BASED POWDER COMBINATION

(75) Inventor: Mats Larsson, Helsingborg (SE)

(73) Assignee: Hoganas AB (Publ), Hoganas (SE)

( * ) Notice: Subject to any disclaimer, the term of this patent is extended or adjusted under 35 U.S.C. 154(b) by 637 days.

(21) Appl. No.: 12/669,140

(22) PCT Filed: Jul. 10, 2008

(86) PCT No.: PCT/EP2008/058999

§ 371 (c)(1),
(2), (4) Date: May 28, 2010

(87) PCT Pub. No.: WO2009/010445

PCT Pub. Date: Jan. 22, 2009

(65) Prior Publication Data

US 2010/0233014 A1 Sep. 16, 2010

Related U.S. Application Data

(60) Provisional application No. 60/935,004, filed on Jul. 20, 2007.

(30) Foreign Application Priority Data

Jul. 17, 2007 (DK) ..... 2007 01057

(51) Int. Cl.
*C22C 33/02* (2006.01)
*B22F 1/00* (2006.01)
*B22F 3/12* (2006.01)

(52) U.S. Cl.
CPC ..... *C22C 33/0207* (2013.01); *C22C 33/0264* (2013.01); *B22F 2998/10* (2013.01)
USPC ..... 75/255; 75/252; 75/231; 75/243; 75/246; 419/11; 419/31; 419/32; 419/36; 419/38

(58) Field of Classification Search
CPC ..... B22F 1/0003; B22F 1/0059; B22F 1/025; B22F 3/02; B22F 3/10; B22F 2998/10; B22C 33/0264; C22C 33/0207
USPC ..... 75/255, 252, 246; 419/32, 62
See application file for complete search history.

(56) References Cited

U.S. PATENT DOCUMENTS

| | | | | |
|---|---|---|---|---|
| 4,238,221 | A * | 12/1980 | Sevensson | 75/352 |
| 4,393,563 | A * | 7/1983 | Smith | 419/28 |
| 5,308,702 | A * | 5/1994 | Furukimi et al. | 428/403 |
| 5,605,559 | A | 2/1997 | Unami et al. | |
| 6,338,747 | B1 * | 1/2002 | Kosco | 75/243 |
| 2001/0028859 | A1 | 10/2001 | Ozaki et al. | |
| 2002/0048526 | A1 | 4/2002 | Nakamura et al. | |
| 2002/0146341 | A1 | 10/2002 | Mars et al. | |
| 2006/0222554 | A1 | 10/2006 | Singh et al. | |
| 2007/0081914 | A1 | 4/2007 | Yoshihiro et al. | |
| 2008/0089801 | A1 | 4/2008 | Larsson | |

FOREIGN PATENT DOCUMENTS

| | | | |
|---|---|---|---|
| EP | 0 677 591 | A1 | 10/1995 |
| EP | 1 184 476 | A2 | 3/2002 |
| GB | 2 431 166 | A | 4/2007 |
| RU | RU 2 043 868 | C1 | 9/1995 |
| WO | WO 00/23216 | A1 | 4/2000 |
| WO | WO 02/38315 | A1 | 5/2002 |
| WO | WO 2006/083206 | A1 | 8/2006 |

OTHER PUBLICATIONS

International Search Report (PCT/ISA/210) dated Apr. 20, 2009 for PCT/EP2008/058999.
Written Opinion of the International Searching Authority (PCT/ISA/237) dated Apr. 20, 2009 for PCT/EP2008/058999.
International Preliminary Report on Patentability (PCT/IPEA/409) dated Jun. 10, 2009 for PCT/EP2008/058999.

* cited by examiner

*Primary Examiner* — George Wyszomierski
*Assistant Examiner* — Ngoclan T Mai
(74) *Attorney, Agent, or Firm* — Buchanan Ingersoll & Rooney P.C.

(57) ABSTRACT

A powder metallurgical combination is provided comprising an iron-based powder A comprising core particles of iron to which core particles nickel is diffusion alloyed and wherein said nickel diffusion alloyed to said core particles comprises 4-7% (preferably 4.5-6%) by weight of said iron-based powder A, and a powder B substantially consisting of particles of pure iron. Further a method is provided for preparing a powder metallurgical combination.

23 Claims, No Drawings

IRON-BASED POWDER COMBINATION

FIELD OF THE INVENTION

The present invention refers to iron-based powder metallurgical combinations and to methods for preparing sintered powder metallurgical components there from. More specifically the invention refers to the production of sintered components including nickel and nickel together with copper by using these combinations.

BACKGROUND OF THE INVENTION

Within the powder metallurgical field, copper and nickel has since long been used as alloying elements in the production of high strength sintered components.

Sintered iron-based components can be produced by mixing alloying elements with iron based powders. However, this may cause problems with dust and segregation which may lead to variations in size and mechanical properties of the sintered component. As for nickel powder used in powder metallurgy the absence of "dusting" is of outmost importance as nickel dust is hazardous and creates a work environmental problem. In order to avoid segregation the alloying elements may be pre-alloyed or diffusion alloyed with the iron powder. In one method the iron powder is diffusion alloyed with copper and nickel for production of sintered components from iron-based powder compositions containing nickel and copper.

WO 2006/083206 relates to a powder metallurgical combination comprising an iron-based powder A essentially consisting of core particles of iron pre-alloyed with Mo and having 6-15% by weight of copper diffusion alloyed to the core particles, an iron-based powder B essentially consisting of particles of iron pre-alloyed with Mo and having 4.5-8% by weight of Ni diffusion alloyed to the core particles, and an iron-based powder C essentially consisting of particles of iron pre-alloyed with Mo. The invention of this document does not relate to powders not comprising Mo or powder mixtures containing pure iron-powder.

UK patent application GB 2 431 166 relates to making a wear resistant member by compacting a powder mixture containing a matrix forming powder and a hard phase forming powder. The matrix forming powder containing 90 mass % or more of particles having a maximum diameter of 46 μm, and the hard phase forming powder being 40 to 70 mass % with respect to the powder mixture; and a mixture of the two powders are compacted powder and sintered. The hard phase forming powder can consist of 20-60 wt % Mo 3-12 wt % Cr, 1-12 wt % Si and the balance Co and inevitable impurities. The matrix forming powder can be obtained by using one of the powders A-E (page 19-20). None of the powders A-E comprise a pure iron.

US 2001/0028859 provides an iron-based powder composition for powder metallurgy having excellent flowability at room temperature and a warm compaction temperature, having improved compactibility enabling lowering ejection force in compaction. The iron-based powder composition comprises an iron-based powder, a lubricant, and an alloying powder. None of the embodiments illustrate the use of pure iron powder combined with a diffusion alloyed iron-based powder.

It is however obvious that, when producing a sintered iron-based component, from a powder wherein copper and nickel are diffusion alloyed, the content of the alloying elements in the sintered iron-based component will be substantially identical with the content of alloying elements in the used diffusion alloyed powder, and that in order to reach different contents of the alloying elements in the sintered component yielding different properties, iron-based powders having different contents of the alloying elements have to be used.

A problem is, among other things, that a specific powder is required for each desired chemical composition of a sintered iron-based component having alloying elements from e.g. nickel, or nickel in combination with copper. Another problem is to assure proper mechanical properties of such a sintered iron-based component having alloying elements from nickel, or nickel in combination with copper component and combined with pure iron powder.

SUMMARY OF THE INVENTION

It is an object of the present invention to, among other things, solve the abovementioned technical problem of the prior art.

It has surprisingly been found that the content of nickel diffusion bonded to the iron powder, both when the nickel containing diffusion alloyed powder is used in combination with essentially pure iron powder, and also when the nickel alloyed iron-based powder is used in combination with iron powder having copper diffusion bonded to the surface and essentially pure iron powder, is of outmost importance for properties such as:

- the dimensional change between the compacted and sintered component,
- mechanical properties of the sintered component,
- compressibility of the diffusion bonded nickel containing powder and
- the degree of bonding of nickel to the iron powder.

In order to obtain sufficient hardness, tensile strength and yield strength and sufficient low and stable dimensional change for components containing iron, nickel and carbon, in combination with high degree of bonded nickel particles, it has been found that the amount of nickel diffusion bonded to the surface of the nickel containing diffusion alloyed powder should be between 4-7% by weight, preferably 4.5-6% by weight.

Further the present invention provides a method of eliminating the need of producing a specific powder for each desired chemical composition of the sintered iron-based component having alloying elements from nickel, or nickel in combination with copper. The invention also offers the advantage of providing a combination of iron powder, iron powder diffusion alloyed with copper and iron powder diffusion alloyed with nickel wherein the segregation of alloying elements and hence the variation of mechanical properties of components produced from said combination is minimized.

In brief the invention concerns a powder metallurgical combination of a nickel-alloyed iron-based powder mixed with substantially pure iron powder. The nickel-alloyed iron-based powder is comprised of core particles of iron, which is diffusion alloyed with nickel.

Additionally, the powder metallurgical powder may further comprise pure iron powder particles additionally diffusion alloyed with copper.

The invention also concerns the iron-based powder comprising core particles of iron, which is diffusion alloyed with nickel.

The invention also concerns a method comprising the steps of combining essentially pure iron powder with iron powder having nickel diffusion bonded to the surface of the iron powder or combining essentially pure iron powder with iron powder having nickel diffusion bonded to the surface the iron powder and iron powder having copper diffusion bonded to the surface of the iron powder, mixing the iron-based powders in predetermined amounts, possibly mixing the combination with graphite and/or optionally other additives, compacting the mixture and sintering the obtained green bodies into sintered bodies having a negligible variation of alloying elements and variation of mechanical properties.

DETAILED DESCRIPTION OF THE INVENTION

Specifically the iron-based powder metallurgical combination according to the invention may for example comprise or consist of:

- an iron-based powder A essentially consisting of core particles of iron, whereby 4-7%, preferably 4.5-6% by weight of nickel is diffusion alloyed to the core particles, and
- an iron-based powder B, essentially consisting of particles of pure iron.

That the iron-based powder B essentially consists of particles of pure iron or consists of essentially pure iron, or that the iron-based powder A essentially consists of core particles of iron diffusion alloyed with nickel means that the total amount of particles only contains the defined particles and trace amounts of other components, where "trace amounts" indicate that the other components are not intentionally added.

In particular the essentially pure iron powder is not pre-alloyed with any other metal.

Optionally, the powder metallurgical combination may comprise an iron-based powder, C, essentially consisting of core particles of iron having copper diffusion alloyed to the core particles. "Essentially consisting of" has the same definition for powder C as for powder A and B. Suitable powders may be Distaloy Cu and Distaloy ACu available from Höganäs AB, Sweden, having about 10% by weight of copper diffusion alloyed to the iron powder, or of Distaloy MH, available from Höganäs AB, Sweden, having about 25% by weight of copper diffusion alloyed to the iron powder.

Other elements in the form of impurities, such as nickel, copper, chromium, silicon, phosphorous and manganese pre-alloyed to the base powder of powder A, B and C may be present.

In order to produce a sintered component from the powder combination according to the present invention the respective amounts of powder A, and B or powder A, B and C are determined and mixed with graphite in the amount required in order to obtain sufficient mechanical properties, the obtained mixture may be mixed with other additives before compaction and sintering. The amount of graphite which is mixed in the powder combination is up to 1%, preferably 0.2-0.8%.

Other additives may be selected from the group consisting of lubricants, binders, other alloying elements, hard phase materials, machinability enhancing agents.

The relation between powder A, B and C is preferably chosen so that the copper content will be 0-4%, preferably 0.5-3% by weight and the nickel content will be 0.5-6%, preferably 1-5% by weight of the sintered component.

The powders are mixed with graphite to obtain the final desired carbon content. The powder combination is compacted at a compaction pressure between 400-1000 MPa and the obtained green body is sintered at 1100-1300° C. for 10-60 minutes in a protective atmosphere. The sintered body may be subjected to further post treatments, such as heat treatment, surface densification, machining etc.

According to the present invention sintered components containing various amounts of nickel or copper and nickel may be produced. This is achieved by using a combination of two (A and B) or three (A and B and C) different powders, which are mixed in different proportions to achieve a powder having the required chemical composition for the actual sintered component.

Example 1

This example demonstrates the influence of different contents of nickel diffusion bonded to the surface of the iron powder.

Iron-based powders having different content of nickel diffusion bonded to the surface of the iron powder were produced by mixing 2%, 4%, 6%, 10%, 15% and 20% by weight respectively, of Ni-powder, INCO 123 from the company INCO Europe Ltd, UK, according to table 1, with the iron powder ASC100.29 from Höganäs AB, Sweden. The mixed powders were then subjected to a diffusion bonding treatment by annealing the powders at 840° C. during 60 minutes in an atmosphere of dissociated ammonia, (25% hydrogen, 75% nitrogen). The obtained material was further crushed and sieved and powders having a particle size less than 212 μm were obtained.

Metallographic Structures and Mechanical Properties

The above produced powders were further mixed with ASC100.29, (except sample 2-2 and 4-4), graphite UF4 from Kropfmühl AG, Germany and as lubricant amide wax from Clariant, Germany giving powder metallurgical compositions containing 2% or 4% by weight of nickel, 0.8% of graphite and 0.8% of amide wax, according to table 1. For comparison reasons powder metallurgical compositions having 2% or 4% by weight of admixed nickel powder, 0.8% by weight of graphite and 0.8% by weight of amide wax were produced, (sample 2-0 and 4-0).

The compositions were pressed at 600 MPa into tensile test samples according to ISO 2740, the samples were further sintered at 1120° C. for 30 minutes in an atmosphere of 90% nitrogen/10% hydrogen.

TABLE 1

| Sample no | Ni content of composition [% by weight] | Ni content of diffusion bonded powder [% by weight] | Graphite [% by weight] | Amide wax [% by weight] |
|---|---|---|---|---|
| 2-0 | 2 | — | 0.8 | 0.8 |
| 2-2 | 2 | 2 | 0.8 | 0.8 |
| 2-4 | 2 | 4 | 0.8 | 0.8 |
| 2-6 | 2 | 6 | 0.8 | 0.8 |
| 2-10 | 2 | 10 | 0.8 | 0.8 |
| 2-15 | 2 | 15 | 0.8 | 0.8 |
| 2-20 | 2 | 20 | 0.8 | 0.8 |
| 4-0 | 4 | — | 0.8 | 0.8 |
| 4-4 | 4 | 4 | 0.8 | 0.8 |
| 4-6 | 4 | 6 | 0.8 | 0.8 |
| 4-10 | 4 | 10 | 0.8 | 0.8 |
| 4-15 | 4 | 15 | 0.8 | 0.8 |
| 4-20 | 4 | 20 | 0.8 | 0.8 |

The obtained sintered samples were tested with regards to tensile and yield strength according to EN 10002-1, hardness according to ISO 4498, dimensional change according to ISO 4492.

Metallographic examinations were performed by light optical microscopy. Table 2 shows result from metallographic examination and table 3 shows result from mechanical testing.

TABLE 2

| Sample no | Metallographic examination |
|---|---|
| 2-0 | Uneven distribution of nickel, large areas of coarse pearlite |
| 2-2 | Even distribution of nickel, smaller and finer pearlite areas |
| 2-4 | Even distribution of nickel, both finer and coarser pearlite areas. |
| 2-6 | Uneven distribution of nickel, both finer and coarser pearlite areas. |
| 2-10 | Uneven distribution of nickel, large areas of coarse pearlite. |
| 2-15 | Matrix contains coarse pearlite and large austenitic areas due to locally high nickel content. |
| 2-20 | Matrix contains coarse pearlite and large austenitic areas due to locally high nickel content. |
| 4-0 | Uneven distribution of nickel, large areas of austenite and coarse pearlite |
| 4-4 | Even distribution of nickel, smaller and finer pearlite areas |
| 4-6 | Uneven distribution of nickel, both finer and coarser pearlite areas. |
| 4-10 | Uneven distribution of nickel, large areas of coarse pearlite. |
| 4-15 | Matrix contains coarse pearlite and large austenitic areas due to locally high nickel content. |
| 4-20 | Matrix contains coarse pearlite and large austenitic areas due to locally high nickel content. |

The result presented in table 2 shows that when nickel powder is admixed to the iron powder the distribution of nickel in the matrix is uneven and less desirable metallographic structures are obtained, these undesirable structures e.g. comprise large areas of coarse pearlite or large areas of austenite and coarse pearlite, (samples 2-0 and 4-0). On the other hand, when 10% or more by weight of nickel is diffusion bonded (diffusion alloyed) to the iron powder the samples contains also less desirable metallographic structures such as large areas of coarse pearlite, large austenite areas and coarse pearlite in combination with large austenite areas. Such structures have a negative influence on mechanical properties, especially fatigue strength. When 6% nickel is diffusion bonded to the iron powder a metallographic structure containing both finer and coarser pearlite areas is obtained, although the distribution of nickel is uneven, such structures are acceptable in relation to mechanical properties.

TABLE 3

| Sample no | Tensile strength [MPa] | Yield strength [MPa] | Dimensional change [%] | Hardness [HV10] |
|---|---|---|---|---|
| 2-0 | 477 | 285 | −0.18 | 143 |
| 2-2 | 463 | 283 | −0.09 | 156 |
| 2-4 | 465 | 275 | −0.10 | 152 |
| 2-6 | 463 | 272 | −0.10 | 151 |
| 2-10 | 460 | 258 | −0.10 | 151 |
| 2-15 | 457 | 262 | −0.09 | 153 |
| 2-20 | 450 | 260 | −0.09 | 154 |
| 4-0 | 538 | 320 | −0.34 | 181 |
| 4-4 | 520 | 319 | −0.20 | 178 |
| 4-6 | 519 | 308 | −0.21 | 177 |
| 4-10 | 507 | 288 | −0.20 | 177 |
| 4-15 | 494 | 285 | −0.18 | 178 |
| 4-20 | 493 | 282 | −0.17 | 165 |

Table 3 shows that when nickel powder is admixed to the iron powder the dimensional change is substantially higher compared to when nickel is diffusion bonded to the iron powder. Further the tensile strength and yield strength is negatively influenced by an increasing amount of nickel, diffusion bonded to the iron powder, which at 6% by weight of the diffusion bonded is acceptable but at 10% may be regarded as not acceptable.

Determination of Compressibility

The obtained diffusion bonded powders having 2%, 4% 6%, 10%, 15% and 20% by weight of nickel diffusion bonded to the surface of the iron powder were further tested with regards to compressibility. The samples were compacted at 600 MPa into green density test samples according to ISO 3927 with lubricated tool die. Table 4 shows the result of green density measurements.

TABLE 4

| Amount of diffusion bonded Ni [% by weight] | Green density [g/cm$^3$] |
|---|---|
| 2 | 7.15 |
| 4 | 7.13 |
| 6 | 7.12 |
| 10 | 7.09 |
| 15 | 7.07 |
| 20 | 7.05 |

The result from table 4 indicates that when 10% or more of nickel powder is diffusion bonded to the iron powder an unacceptable negatively influence on the compressibility is obtained.

Determination of Degree of Bonding

The amount of particles smaller than 8.8 μm and 18 μm respectively were determined by a laser diffraction method, instrument Sympatec, according to ISO 13320-1 for the diffusion bonded powders having 2%, 4% 6%, 10%, 15% and 20% by weight of nickel diffusion bonded to the surface of the iron powder. Table 5 shows the result of measurements of degree of bonding.

TABLE 5

| Amount of diffusion bonded Ni [% by weight] | Amount smaller than 8.8 μm [% by weight] | Amount smaller than 18 μm [% by weight] | Estimated amount Ni powder smaller than 18 μm [% by weight of total Ni powder] |
|---|---|---|---|
| 2 | 0 | 0.6 | 0 |
| 4 | 0 | 0.6 | 0 |
| 6 | 0 | 1.0 | 7 |
| 10 | 0.1 | 1.4 | 10 |
| 15 | 0.3 | 2.2 | 13 |
| 20 | 0.3 | 2.8 | 11 |

As substantially all particles of the iron powder, used for the production of the diffusion bonded powder, are greater than 8.8 μm and only about 0.6% by weight of the particles of the iron powder are smaller than 18 μm, the amount of particles smaller than 8.8 μm, and the amount of particles above 0.6% by weight of particles smaller than 18 μm are substantially nickel particles, the amount of not bonded nickel powder can be estimated. Table 5 shows that when substantially more than 6% of nickel powder, by weight of the resulting diffusion bonded powder, about more than 10% of the nickel powder will be present as not bonded nickel and also present as finer respirable dust, below 10 μm.

Example 2

This example shows the influence of the amount of nickel powder diffusion bonded to the surface of the iron powder on the mechanical properties of sintered components, when the diffusion bonded nickel containing powders are combined with diffusion bonded copper containing iron powder and graphite.

Iron-based powders having different contents of nickel, 5%, 6%, 10%, 15% and 20% by weight respectively, of nickel powder diffusion bonded to the surface of the iron powder were produced according to example 1.

The obtained nickel containing diffusion bonded powders were further mixed with a copper containing diffusion bonded iron powder, Distaloy ACu, available from Höganäs AB, Sweden, and having 10% of copper diffusion bonded to a core iron powder, graphite, and 0.8% of amide wax as described in example 1. Table 6 shows the obtained compositions. Samples were produced and tested according to example 1, and the following table 7 shows the results.

TABLE 6

| Sample no | Ni content of composition [% by weight] | Ni content of diffusion bonded powder [% by weight] | Cu content of composition [% by weight] | Graphite content of composition [% by weight] |
|---|---|---|---|---|
| 1Cu08C-4-5 | 4 | 5 | 1 | 0.8 |
| 1Cu08C-4-6 | 4 | 6 | 1 | 0.8 |
| 1Cu08C-4-10 | 4 | 10 | 1 | 0.8 |
| 1Cu08C-4-15 | 4 | 15 | 1 | 0.8 |
| 1Cu08C-4-20 | 4 | 20 | 1 | 0.8 |
| 2Cu05C-4-5 | 4 | 5 | 2 | 0.5 |
| 2Cu05C-4-6 | 4 | 6 | 2 | 0.5 |
| 2Cu05C-4-10 | 4 | 10 | 2 | 0.5 |
| 2Cu05C-4-15 | 4 | 15 | 2 | 0.5 |
| 2Cu05C-4-20 | 4 | 20 | 2 | 0.5 |

TABLE 7

| Sample no | Tensile strength [MPa] | Yield strength [MPa] | Hardness [HV10] |
|---|---|---|---|
| 1Cu08C-4-5 | 580 | 365 | 201 |
| 1Cu08C-4-6 | 569 | 357 | 191 |
| 1Cu08C-4-10 | 562 | 349 | 193 |
| 1Cu08C-4-15 | 558 | 337 | 188 |
| 1Cu08C-4-20 | 538 | 330 | 177 |
| 2Cu05C-4-5 | 587 | 354 | 185 |
| 2Cu05C-4-6 | 581 | 356 | 176 |
| 2Cu05C-4-10 | 563 | 337 | 162 |
| 2Cu05C-4-15 | 544 | 329 | 164 |
| 2Cu05C-4-20 | 532 | 317 | 158 |

The results presented in table 7 show that higher tensile strength, yield strength and hardness are obtained when copper is admixed and that the mechanical properties are negatively influenced by an increasing amount of nickel, diffusion bonded to the iron powder, which at 6% by weight of the diffusion bonded is acceptable but at 10% may be regarded as not acceptable.

The invention claimed is:

1. A powder metallurgical combination comprising:

an iron-based powder A consisting of core particles of iron whereby 4-7% by weight of nickel is diffusion alloyed to the core particles, and a powder B, consisting of particles of pure iron and trace amounts of other components.

2. The powder metallurgical combination according to claim 1, wherein the powder metallurgical combination further comprises an iron-based powder C consisting of core particles of iron to which copper is diffusion alloyed.

3. The powder metallurgical combination according to claim 2, wherein said copper diffusion alloyed to said core particles constitute 5-30% by weight of said iron-based powder C.

4. The powder metallurgical combination according to claim 1, wherein an amount of copper in the powder metallurgical combination is within the range 0-4% by weight.

5. The powder metallurgical combination according to claim 1, wherein the amount of nickel in the powder metallurgical combination is within the range 0.5-6% by weight.

6. The powder metallurgical combination according to claim 1, wherein the powder metallurgical combination further comprises graphite in a concentration up to 1% by weight.

7. The powder metallurgical combination according to claim 1, further comprising additives selected from the group consisting of lubricants, binders, hard phase materials, and machinability enhancing agents.

8. The powder metallurgical combination according to claim 1, wherein said core particles of iron of iron-based powder A are diffusion alloyed with 4.5-6% by weight of nickel.

9. The powder metallurgical combination according to claim 2, wherein said copper diffusion alloyed to said core particles constitute 5-15% by weight of said iron-based powder C.

10. A diffusion alloyed iron-based powder consisting essentially of core particles of essentially pure iron, whereby 4-7% by weight of nickel is diffusion alloyed to the core particles.

11. The diffusion alloyed iron-based powder according to claim 10, wherein 4.5-6% by weight of nickel is diffusion alloyed to said core particles of iron.

12. A method of preparing a powder metallurgical combination, the method comprising the steps of:

mixing an iron-based powder A comprising core particles of iron whereby 4-7% by weight of nickel is diffusion alloyed to the core particles, and mixing a powder B substantially consisting of particles of pure iron to the powder metallurgical combination.

13. The method according to claim 12, wherein the method further comprises the step of:

mixing an iron-based powder C comprising core particles of iron to which core particles copper is diffusion alloyed to the powder metallurgical combination.

14. The method according to claim 13, wherein the amount of copper in the powder metallurgical combination is within the range 0.5-4% by weight.

15. The method according to claim 13, wherein the amount of nickel in the powder metallurgical combination is within the range 0.5-6% by weight.

16. The method according to claim 13, wherein the method further comprises mixing graphite to the powder metallurgical combination.

17. The method according to claim 13, wherein the method further comprises mixing additives selected from the group consisting of lubricants, binders, other alloying elements, hard phase materials, and machinability enhancing agents, to the powder metallurgical combination.

18. The method according to claim 13, wherein the method further comprises compacting the powder metallurgical combination to form a compacted body.

19. The method according to claim 18, wherein the method further comprises sintering said compacted body.

20. The method according to claim 12, wherein said iron-based powder A comprises 4.5-6% by weight of nickel diffusion alloyed to said iron core particles.

21. A diffusion alloyed iron-based powder consisting of core particles of essentially pure iron with 4-7% by weight of nickel is diffusion alloyed to the core particles.

22. A method of preparing a powder metallurgical combination, the method comprising the steps of:

mixing an iron-based powder A consisting essentially of core particles of essentially pure iron with 4-7% by weight of nickel is diffusion alloyed to the core particles, and mixing a powder B substantially consisting of particles of pure iron to the powder metallurgical combination.

23. A method of preparing a powder metallurgical combination, the method comprising the steps of:

mixing an iron-based powder A consisting of core particles of essentially pure iron with 4-7% by weight of nickel is diffusion alloyed to the core particles, and mixing a powder B substantially consisting of particles of pure iron to the powder metallurgical combination.

* * * * *